US006116335A

United States Patent [19]

Beamer et al.

[11] Patent Number: 6,116,335

[45] Date of Patent: Sep. 12, 2000

[54] FLUID FLOW HEAT EXCHANGER WITH REDUCED PRESSURE DROP

[75] Inventors: Henry Earl Beamer, Middleport; Chris A. Calhoun, Niagara Falls, both of N.Y.

[73] Assignee: Delphi Technologies, Inc., Troy, Mich.

[21] Appl. No.: 09/385,732

[22] Filed: Aug. 30, 1999

[51] Int. Cl.[7] ..... F28F 9/02

[52] U.S. Cl. ..... 165/174; 165/175

[58] Field of Search ..... 165/174, 175, 165/71

[56] References Cited

U.S. PATENT DOCUMENTS

| | | | |
|---|---|---|---|
| 4,187,090 | 2/1980 | Bizzarro et al. | 165/174 X |
| 4,596,287 | 6/1986 | Wissmath | 165/174 |
| 4,940,086 | 7/1990 | Stay | 165/174 X |
| 5,067,561 | 11/1991 | Joshi et al. | 165/174 X |
| 5,186,249 | 2/1993 | Bhatti et al. | 165/174 |
| 5,465,783 | 11/1995 | O'Connor | 165/134.1 |
| 5,531,266 | 7/1996 | Ragi et al. | 165/174 X |
| 5,762,130 | 6/1998 | Uibel et al. | 165/71 |
| 5,941,303 | 8/1999 | Gowan et al. | 165/174 X |

FOREIGN PATENT DOCUMENTS 10-292996 11/1998 Japan .

*Primary Examiner*—Christopher Atkinson
*Attorney, Agent, or Firm*—Patrick M. Griffin

[57] ABSTRACT

An automotive radiator reduces coolant pressure drop with a novel flow turning structure integrally molded into the inlet header tank, opposite the inlet pipe. A pair of compound curved surfaces, sloping toward opposite directions from a crest edge, split and divide the flow leaving the inlet pipe and send it proportionately toward opposite ends of the tank, smoothing out the flow transition and reducing the attendant pressure loss. The curved surfaces also have a component of curvature toward the flow tubes, as well as being sloped toward opposite ends of the tank.

2 Claims, 3 Drawing Sheets

FLUID FLOW HEAT EXCHANGER WITH REDUCED PRESSURE DROP

TECHNICAL FIELD

This invention relates to automotive heat exchangers in general, and specifically to a fluid flow heat exchanger, such as a radiator, with a novel in tank structure for reducing the pressure drop caused by flow turning losses.

BACKGROUND OF THE INVENTION

Automotive heat exchangers that use a pumped, liquid heat exchange medium, as opposed to a compressed gaseous/liquid heat exchange medium, include radiators and heaters. Typically, these include two elongated manifolds or header tanks, one on each side of the heat exchanger, with a central core consisting of a plurality of evenly spaced, flattened flow tubes and interleaved corrugated air fins running between the two tanks. Each tank is generally box shaped, with parallel side walls, a back wall joining the side walls, two axially opposed ends, and an open area opposite the back wall, which is eventually closed off when it is fixed leak tight to one side of the core. Each header tank distributes pumped liquid to or from the flow tubes in the core, and is in turn filled or drained by an inlet or outlet pipe opening into the header tank at a discrete location. In typical modern radiators, the header tank is a molded plastic box, and the inlet or outlet pipe is integrally molded to one of the side walls. The pipe, therefore, is oriented both perpendicularly to the length of the tank and perpendicular the flow tubes. Coolant flow entering the inlet pipe must, therefore, turn ninety degrees toward the two ends of the tank before as well as turning ninety degrees again to flow out of the tank interior and into the flow tubes. The converse is true for coolant exiting the return tank through the outlet pipe. An example of a recent radiator with molded plastic, box shaped header tanks may be seen in U.S. Pat. No. 5,762,130, which is fairly typical in its basic flow configuration, apart from being a U flow design, with the inlet and outlet pipe located on one tank. The orientation of the pipes relative to the tank walls and flow tubes is as described above, however.

The design of a radiator or any cross flow heat exchanger with a liquid medium flowing in one direction through flow tubes, and with air blown perpendicularly across the flow tubes, is a compromise between heat exchange efficiency between the two flowing media, and the pressure or pumping losses of the two media. For example, it is well known that decreasing the flow passage cross sectional area will present relatively more surface area of the fluid medium within the flow passage to the air blowing over the flow tube, increasing the heat transfer efficiency from fluid to air. A tube that is smaller on the inside is also thinner on the outside, and so presents less obstruction the air blown over the outside of it, decreasing the air side pressure loss through the core. However, a thinner flow tube creates more fluid pressure loss through the tube, end to end. Some compromise can generally be found between air side pressure drop, tube thickness, and liquid (coolant) pressure drop. However, the ability to reduce total coolant pressure loss (pumping loss) elsewhere in the heat exchanger would allow the use of thinner tubes in general, which would be very positive, considering that thinner tubes also decrease air side pressure loss.

One source of coolant pressure drop through the heat exchanger that has not received a great deal of attention in the prior art is turbulence or "turning" losses that occur at the transition between the pipe opening and the enclosed interior of the header tank, especially the inlet pipe. That is, since the inlet pipe typically enters through a tank side wall, and not the tank back wall, it is oriented perpendicular to the flow tubes, as well, and must change direction both to reach the opposite ends of the tank and in order to flow into the tubes. The turning transition is not a great source of pressure loss when the interior volume of the tanks is large, since a large interior volume can act as a large pressure reservoir to "absorb" and distribute coolant to the flow tubes. As available underhood space shrinks, however, radiator header tanks become smaller, and the parallel side walls become closer. Flow exiting the opening of the inlet pipe (through the first side wall) impinges on the proximate, opposed second side wall, creating turbulence and pressure loss before it can be distributed toward the opposite ends of the tank and into the flow tubes.

The other liquid medium heat exchanger typically found in an automobile, the heater core, has a similar cross flow configuration, but faces a different problem. There, the inlet pipe generally opens through the back wall of the header tank, in line with, rather than perpendicular to, the flow tubes. The flow thus impinges directly onto the ends of the nearest aligned flow tubes, rather than against a side wall of the tank, which would theoretically be positive, in terms of direct flow into the tubes with minimal pressure loss. However, the fact that the ends of the nearest tubes are in line with the inlet pipe is a detriment, because the force of the impinging flow against the near tube ends erodes and damages them. Therefore, it has been proposed in several heater core designs to place a protective tent or baffle like structure between the inlet pipe opening and the ends of the nearest aligned flow tubes. These act as a road block, in effect, interrupting the flow at that point, rather than smoothing it out, and would actually increase total coolant pressure drop across the core. This is an acceptable price in that context, however, since it is considered necessary to protect the otherwise eroded tubes.

SUMMARY OF THE INVENTION

The subject invention provides a radiator header tank that reduces coolant pressure drop across the core by reducing turning losses at the transition from the inlet pipe to the interior of the header tank.

In the embodiment disclosed, the inlet header tank is a basic elongated, open box shape with parallel first and second side walls, a back wall joining the sides walls, and axially opposed ends. A series of flat flow tubes is regularly spaced along the length of the header tank, perpendicular thereto, and an inlet pipe opens through the tank's first side wall, opposed to the second side wall and perpendicular to both the flow tubes and to the length of the tank. Three mutually orthogonal axes are established, in effect, and flow exiting the inlet pipe is forced to turn abruptly in two ninety degree directions, creating a good deal of potential turbulence and pressure loss.

To reduce such turning losses, a flow turning structure is molded within the header tank, opposite the opening of the inlet pipe, integral to both the tank's second side wall and back wall. A pair of curved surfaces have a shape and compound curvature that smoothes out the transition in the flow. Each surface slopes away from a mutual crest edge, sloping away form the inlet pipe opening and toward the opposite ends of the tank. In addition, the curved surfaces slope away from the back wall of the tank and in the direction of the tubes, as does the crest edge. Flow exiting the inlet pipe now is divided by the crest edge and directed toward the opposite ends of the tanks and the flow tubes, smoothly, rather than abruptly. This significantly reduces coolant pressure drop within the radiator as a whole in a very cost effective manner. This allows thinner flow tubes to be used than would otherwise be possible.

BRIEF DESCRIPTION OF THE DRAWINGS

These and other features of the invention will appear from the following written description, and from the drawings, in which.

DESCRIPTION OF THE PREFERRED EMBODIMENT

Figure 1:
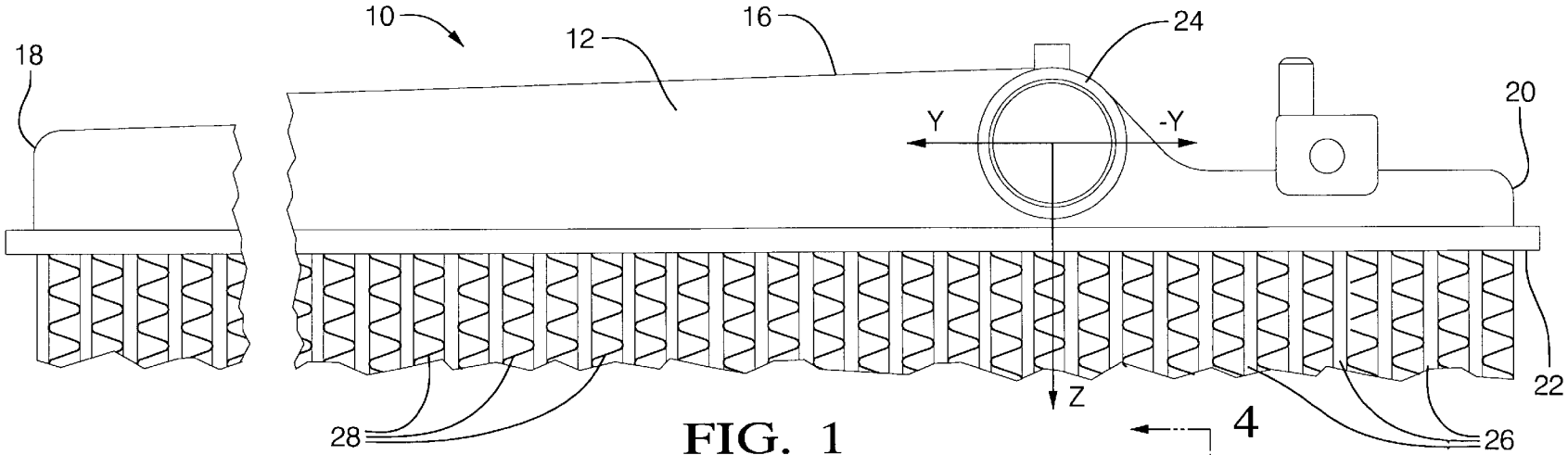
FIG. 1 is a view of the inlet header tank of a cross flow radiator along the axis of the inlet pipe, with most of the core broken away.
Figure 2:
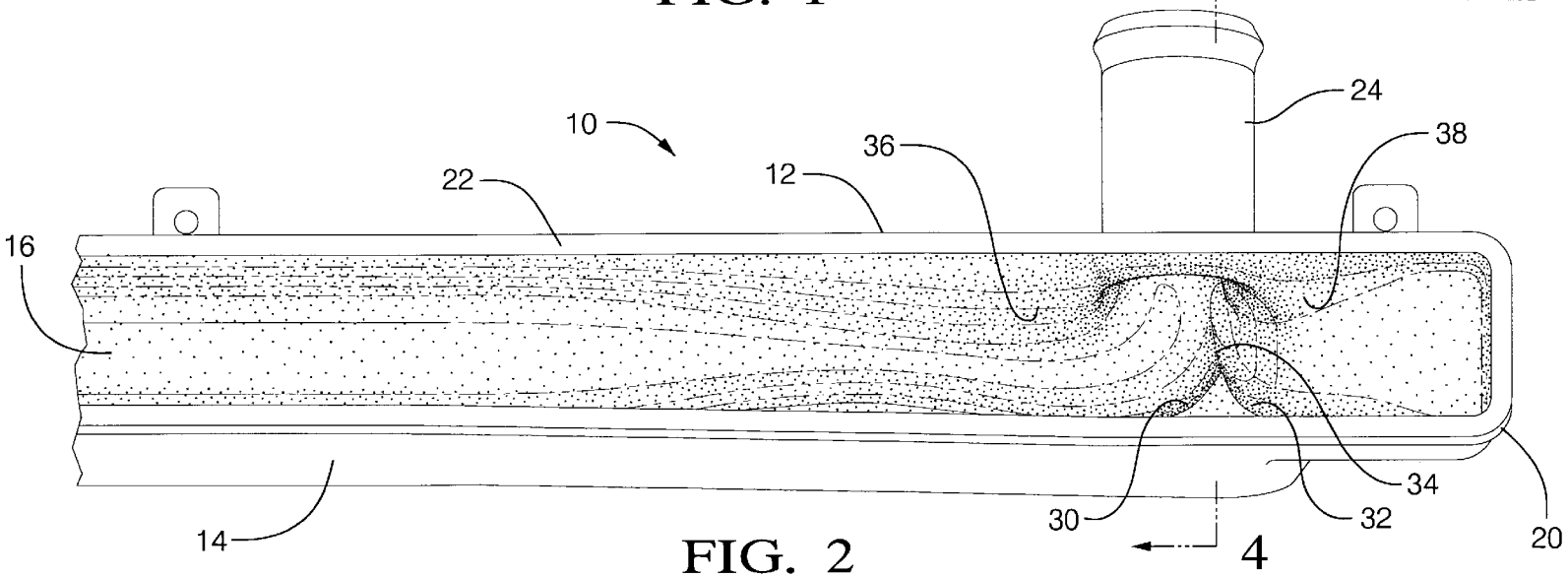
FIG. 2 is a perspective view of the interior of a molded plastic inlet header tank incorporating a preferred embodiment of the invention.

Referring first to FIGS. 1 and 2, an inlet header tank according the invention is indicated generally at 10. Tank 10 is integrally molded of a suitable plastic, with the typical elongated box shape consisting of parallel first and second side walls 12 and 14 respectively, a back wall 16 joining the side walls, axially opposed ends 18 and 20, and a peripheral open flange 22. A cylindrical inlet pipe 24 opens through the first side wall 12, generally perpendicular thereto, and opposed to the inner surface of the second side wall 14. A radiator core consists of a plurality of evenly spaced, flat flow tubes 26, which are generally fabricated aluminum, with interleaved corrugated air fins 28 brazed between. The flow tubes 26 are maintained in their evenly spaced configuration by a pair of conventional slotted header plates (not illustrated), located on each side. One header plate is ultimately clinched and sealed to the tank flange 22 when the radiator is completed, leaving the ends of the flow tubes 26 on one side open to the interior of tank 10. A tank like 10, not separately illustrated, is clinched to the other header plate, and the opposite ends of the flow tubes 26 open to its interior. A similarly oriented outlet pipe would generally be molded to the other tank, in which case it would be referred to as the outlet tank, In the case of a U flow design, the opposite tank would be simply a return tank, and the outlet pipe would be located near the opposite end of the inlet tank 10.

Figure 5:
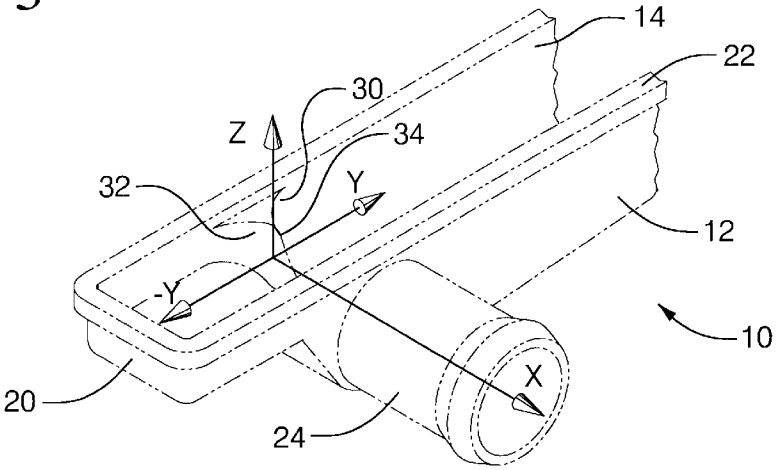
FIG. 5 is a schematic representation of a reference frame describing the orientation of the tank and flow tubes.

Referring next to FIGS. 1 and 5, a convenient reference frame to describe and orient the various structural features and the coolant flow is described. The length of the inlet header tank 10 (and of the opposed tank) can be considered to lie along a first axis indicated at Y. The flow tubes 26 can be considered to be spaced evenly along the first axis Y, aligned with and parallel to a second axis Z, which is perpendicular to the first axis Y. The inlet pipe 24 is defined along yet a third axis X which is perpendicular to the other two, and the intersection of the three defines an origin as indicated in FIG. 5. The direction along the first or Y axis is further subdivided as Y or −Y simply to indicate movement in a direction toward opposite tank ends 18 or 20 respectively. It should be understood that other tank designs might be more cylindrical or curved in shape than tank 10, without flat or substantially flat walls like 12, 14 and 16. However, such a tank will still have a length axis Y, and portions or quadrants thereof will still correspond to the three walls 12, 14 and 16, even if curved or arcuate. Likewise, the center axis X of the inlet pipe 24 might not be perfectly perpendicular to the other two axes, but, in a typical radiator tank design, it will be substantially perpendicular, and will open through a part of the tank which, like first side wall 12, faces an opposed part of the tank, like second side wall 14. Therefore, regardless of actual tank shape, the inlet (or outlet pipe) will be substantially perpendicular both to the length of the tank 10, and to the flow tubes 26. It is this mutually orthogonal relationship that creates the potential turbulence and pressure loss at the transition, especially in a compact tank with a small volume interior.

Figure 3:
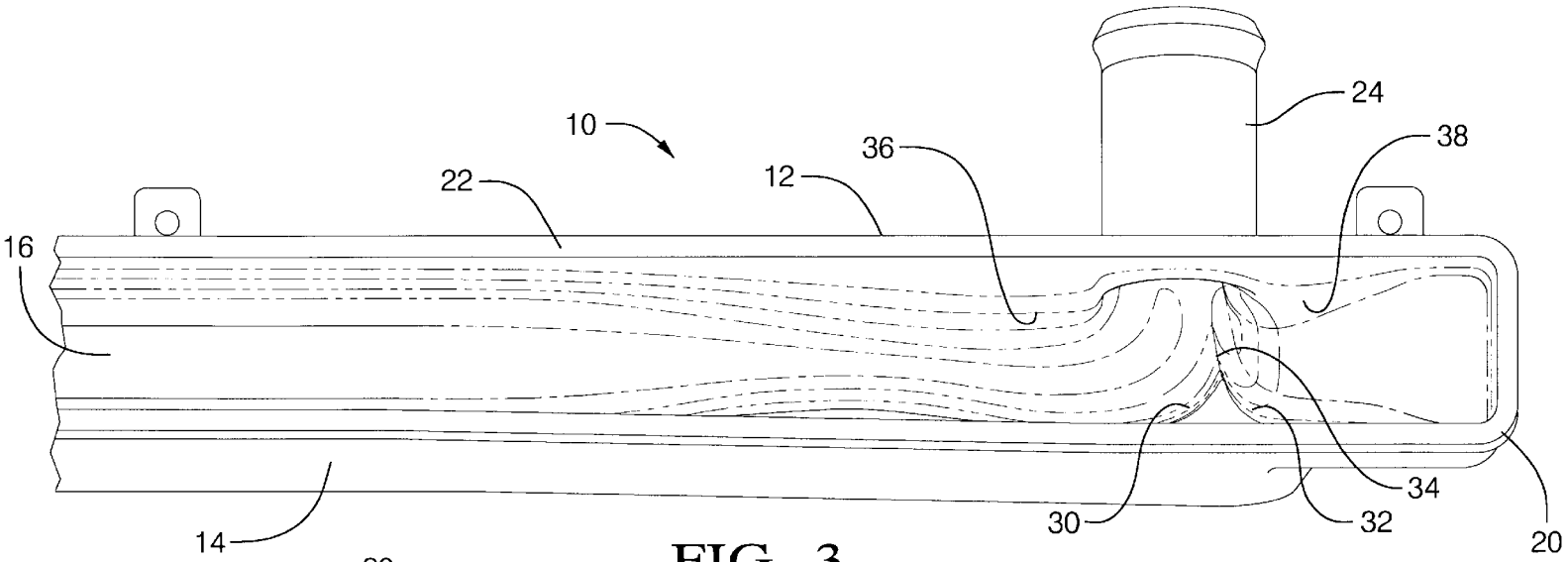
FIG. 3 is a schematic representation of the interior of the inlet header tank, indicating shape and contour.
Figure 4:
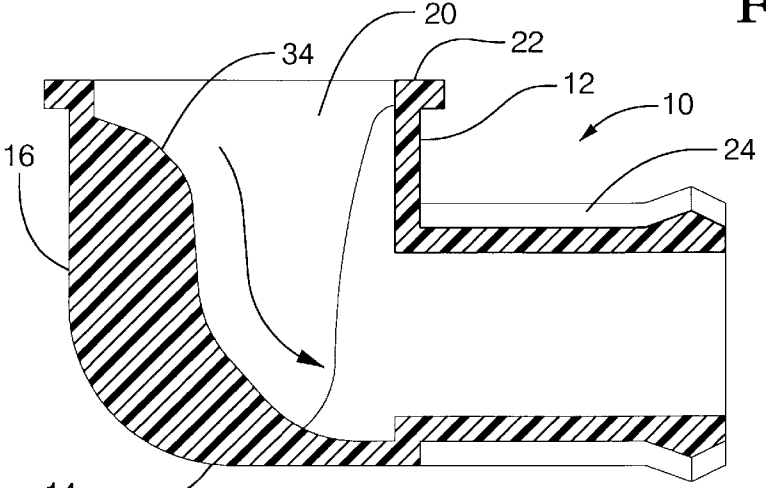
FIG. 4 is a cross section of the tank taken along the line 4—4 of FIG. 2.

Referring next to FIGS. 2 through 4, the inlet tank 10 of the invention has a flow turning structure integrally molded within and to its interior, comprised of a first curved surface 30, a second curved surface 32, and a common crest edge 34 at which they intersect. These three surfaces together may comprise the outer surface of a solid mass of material securely molded to both the inside of second side wall 14 and back wall 16, opposed to the opening of inlet pipe 24. Or, the three surfaces could instead be the convex inner surfaces of a concavity integrally molded into the second side wall 14 and back wall 16. However formed, each curved surface 30 and 32 has a compound curvature, that is, each slopes away from the inlet pipe 24 and toward a respective tank end 18 or 20 (in the Y or −Y direction), and also slopes away from the back wall 16, in the Z direction, toward the ends of the flow tubes 26. Consequently, the crest edge 34 also slopes down in the Z direction, as best seen in FIG. 4. In addition, in the embodiment disclosed, the crest edge 34 is not centered right on the center axis X of the inlet pipe 24, but is offset slightly toward the proximate tank end 20. This compound curvature and shape is somewhat difficult to depict visually, and so is indicated both by stipple shading in FIG. 2, and by dashed contour lines in FIG. 3. The embodiment disclosed has other internal integrally molded structure, as well, which cooperates with that just described. A third curved surface 36 is molded to the first side wall 12, at its juncture with the opening of the inlet pipe 24, substantially diagonally opposed to the first curved surface 30. Third curved surface 36 serves to "round out" the otherwise sharp juncture between inlet pipe 24 and the inner surface of first side wall 12, and is sloped in the positive Y direction as defined above. Likewise, a fourth curved surface 38 is integrally molded to the first side wall 12, diagonally opposed to second curved surface 32 and sloped in the −Y direction, to round out the other side of the otherwise sharp juncture. The other two curved surface 36 and 38, when present, would be molded in similar fashion to the first two, and at the same time.

Figure 6:
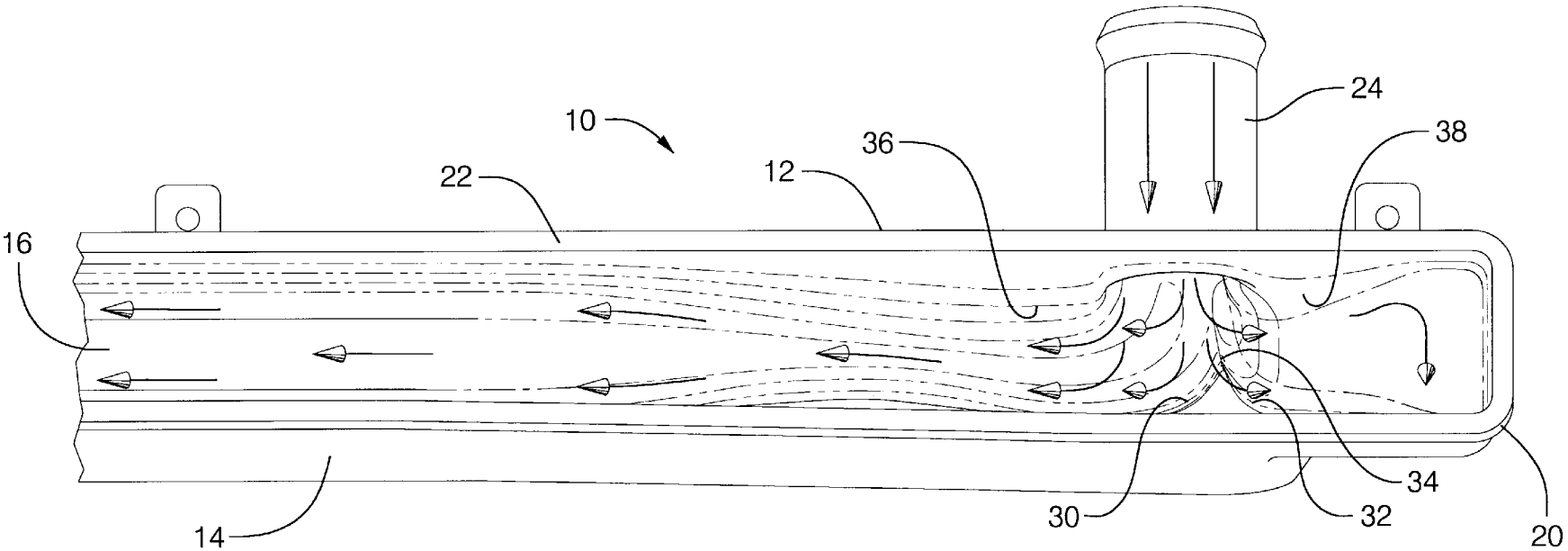
FIG. 6 is a schematic representation of the coolant flow through the tank.

Referring next to FIGS. 4 and 6, the operation of the invention is illustrated. Pumped coolant flow enters inlet pipe 24 and, rather than impinging directly against the second side wall 14, impinges on the flow turning structure as described above. The coolant flow is split or divided by crest edge 34 which, by virtue of its offset location, sends proportionately more of the split flow along the first curved surface 30 and toward the tank end 18, and relatively less along the second curved surface 32, toward the opposite tank end 20. The smooth curve and slope of the surfaces 30 and 32 sends the flow in the Y and −Y directions with less of the sharp, abrupt transition that occurs in a conventional tank, as indicated by the flow arrows in FIG. 6. At the same time, the compound nature of the curvature, with the additional slope away from back wall 16, imparts a small component of flow velocity in the Z axis, toward the flow tubes 26, smoothing the turn in that direction as well, as best illustrated in FIG. 4. The "extra" component to the curvature is also intended to ease the process of pulling apart the two mold sections that would be used to mold the inner and outer surfaces of the tank 10, avoiding any "undercut" that could tend to catch or hang up. The additional component of curvature in the Z direction would have the most effect on the flow tubes 26 nearest the inlet pipe 24. Concurrently with the flow splitting and smooth flow turning just described, the third and fourth curved surfaces 36 and 38 cooperate to smooth out the otherwise abrupt flow transition out of inlet pipe 24 and along first side wall 12, mirroring, in effect, the action of the curved surfaces 30 and 32 to which they are diagonally opposed.

Measurements of the effect of the structure described above on coolant pressure drop have proved very promising. The inclusion of the first and second curved surfaces 30 and 32 alone yielded a seven percent coolant pressure drop reduction, in tests. The additional inclusion of the curved surfaces 36 and 38 boosted that reduction to twelve percent. This is very significant in light of the fact that the modification of the invention can be made at essentially no additional cost, since the tank will be molded by the same process regardless, and one shape is no more costly than another. Variations in the disclosed embodiment could be made. It could be incorporated in an outlet tank, as well, although it is thought that the improvement in pressure drop would be most pronounced in an inlet tank. In a case where the inlet pipe was located very near one end of the inlet tank, so that no flow tubes at all were located in the −Y direction, then a single curved surface, with the same shape and slope, could serve to turn all flow in the positive Y direction. If the inlet pipe 24 were located nearly at the center of the length of tank 10, then the crest edge 34 could be centered relative to inlet pipe 24, rather than offset, so as to divide the flow evenly. The curved surfaces 30 and 32 could, most broadly, be sloped only in the Y and −Y directions, and not compoundly curved in the Z direction as well, but the compound curvature disclosed adds no extra expense to the structure, and is thought to help smooth out the multi directional flow transition necessitated by the three orthogonal axes. Therefore, it will be understood that it is not intended to limit the invention just to the embodiment disclosed.

What is claimed is:

1. In a cross flow automotive radiator having a inlet header tank that is generally a box like structure with an interior defined by elongated first side wall and a generally parallel second side wall disposed along a first axis, a back wall joining said side walls, and two opposite ends opposed along said first axis, which header tank distributes flowing coolant to a plurality of substantially straight flow tubes that are spaced along said first axis, opposed to said header tank back wall and parallel to a second axis that is generally perpendicular to the first axis, said header tank having an inlet pipe disposed substantially along a third axis perpendicular to the other two axes with an opening through said first side wall opposite said second side wall, with said coolant flowing into said header tank at the transition between said tank interior and said inlet pipe opening, the improvement comprising, a flow turning structure within said header tank and disposed on said second side wall and back wall, opposite said first side wall, said flow turning structure including a pair of curved, flow turning surfaces, opposed to said inlet pipe opening, a first curved surface sloping in one direction along said first axis, toward one tank end and away from said back wall, a second curved surface sloping in the opposite direction along said first axis, toward the other tank end and away from said back wall, said first and second surface intersecting at a crest edge that is sloped both toward said flow tubes along said second axis and away from said back wall, whereby coolant flowing out of said pipe opening along said third axis is divided by said crest edge and turned smoothly by said first and second sloping surfaces and along said first axis, toward opposite ends of said tank, reducing turbulence and pressure loss at the transition between said inlet pipe opening and the interior of said header tank.

2. In a cross flow heat exchanger having at least one header tank that is generally a box like structure with an interior defined by elongated first side wall and a generally parallel second side wall disposed along a first axis, a back wall joining said side walls, and two opposite ends opposed along said first axis, which header tank distributes a flowing liquid heat exchange medium to or from a plurality of substantially straight flow tubes that are spaced along said first axis, opposed to said header tank back wall and parallel to a second axis that is generally perpendicular to the first axis, said header tank having a pipe disposed substantially along a third axis perpendicular to the other two axes with an opening through said first side wall opposite said second side wall, with said heat exchange medium flowing into or out of said header at the transition between said tank interior and said pipe opening, the improvement comprising, a flow turning structure within said header tank and disposed on said second side wall and back wall, opposite said first side wall, said flow turning structure including a pair of curved, flow turning surfaces opposed to said pipe opening, a first curved surface sloping in one direction along said first axis, toward one tank end, and a second curved surface sloping in the opposite direction along said second axis, toward the other tank end, and in which said pair of curved surfaces intersect at a crest edge opposed to said pipe opening, whereby heat exchange medium flowing out of or into said pipe opening along said third axis is turned smoothly by said sloping surface along said first axis, toward or away from said tank end, reducing turbulence and pressure loss at the transition between said pipe opening and the interior of said header tank.

* * * * *